United States Patent [19]

Kamrath

[11] Patent Number: 5,058,387

[45] Date of Patent: Oct. 22, 1991

[54] PROCESS TO ULTRAPURIFY LIQUID NITROGEN IMPORTED AS BACK-UP FOR NITROGEN GENERATING PLANTS

[75] Inventor: David J. Kamrath, Asbury, N.J.

[73] Assignee: The BOC Group, Inc., New Providence, N.J.

[21] Appl. No.: 376,058

[22] Filed: Jul. 5, 1989

[51] Int. Cl.[5] ..... F25J 3/00

[52] U.S. Cl. ..... 62/11; 62/40

[58] Field of Search ..... 62/9, 11, 37, 40

[56] References Cited

U.S. PATENT DOCUMENTS

| | | | |
|---|---|---|---|
| 2,951,346 | 9/1960 | Collins et al. | 62/40 |
| 3,485,053 | 12/1969 | Grenier | 62/40 |
| 3,620,032 | 11/1971 | Simonet | 62/40 |
| 4,529,425 | 7/1985 | McNeil | 62/37 |
| 4,668,260 | 5/1987 | Yoshino | 62/40 |
| 4,671,813 | 6/1987 | Yoshino | 62/42 |
| 4,698,079 | 10/1987 | Yoshino | 62/11 |
| 4,780,118 | 10/1988 | Cheung | 62/11 |

*Primary Examiner*—Ronald C. Capossela

*Attorney, Agent, or Firm*—Carol A. Nemetz; Robert I. Pearlman

[57] ABSTRACT

An improved nitrogen generator having a distillation column for separating oxygen and nitrogen, the column having a top and a bottom and a rising vapor stream and a descending liquid stream in countercurrent contact with each other, the improvement comprising means for introducing an amount of liquid nitrogen into the column at an intermediate point in the column wherein the liquid stream composition at said point is substantially equivalent to the liquid nitrogen composition and a means for withdrawing a substantially equivalent amount of purified liquid nitrogen from the top of the column.

32 Claims, 2 Drawing Sheets

PROCESS TO ULTRAPURIFY LIQUID NITROGEN IMPORTED AS BACK-UP FOR NITROGEN GENERATING PLANTS

TECHNICAL FIELD OF THE INVENTION

This invention relates to a process and apparatus for producing high purity liquid nitrogen and, in particular, a process to purify merchant liquid nitrogen containing undesirable amounts of oxygen, using the distillation column of an on-site nitrogen generator, to produce ultrapure liquid nitrogen which may be stored for use during periods of excess demand for nitrogen or the shutdown of the nitrogen generator or may be exported for sale as a premium grade liquid product.

BACKGROUND OF THE PRIOR ART

Nitrogen generators are designed to meet the typical requirements for inerting applications in chemical complexes, oil refineries, pharmaceutical plants, metal processing, semiconductor manufacturing, float glass production and many other key industrial processes. In certain applications, for example silicon wafer fabrication, it is necessary to minimize the oxygen content in the nitrogen produced. Conventional nitrogen generating plants can be operated to produce nitrogen containing less than 0.5 vppm oxygen (where vppm is volumetric parts per million).

Usually, nitrogen generators are provided with a liquid nitrogen storage tank and vaporizer to supply nitrogen during periods of nitrogen plant generator shutdown or when demand exceeds generator capacity. It is also possible to provide merchant liquid nitrogen for plant back-up; however, it is usually produced to standard commercial specifications of 2.0 to 5.0 vppm oxygen. Such nitrogen would not be sufficiently pure for an electronics customer who requires less than 0.5 vppm oxygen content. Even if liquid nitrogen is produced at a high purity in the merchant plant, it may become contaminated during distribution. For example, liquid nitrogen produced at a merchant plant at approximately 1 vppm oxygen may result in a delivered product containing nearly 2 vppm. In contrast, an on-site nitrogen generator can produce product containing less than 0.5 vppm oxygen. Thus it is most desirable to provide for on-site production of liquid nitrogen for use during periods of nitrogen generator outage or excess demand for nitrogen rather than to use merchant liquid nitrogen imported by truck from a liquid nitrogen plant. It is also possible to utilize the nitrogen generator to ultrapurify imported commercial grade product for reshipment to customers requiring ultrahigh purity nitrogen in quantities too small to justify a dedicated onsite plant.

This problem of back-up has been addressed by producing and storing high purity liquid nitrogen from the nitrogen generator. A conventional waste expansion cycle nitrogen generator can produce up to about 5% of its product as ultrapure liquid nitrogen with no loss in overall product recovery This method, however, is not entirely satisfactory. First, about 25 days are required to fill a storage tank sized to provide 30 hours of nitrogen for plant "back-up" and, further, full nitrogen generation capability is not available during this filling period. Secondly, power consumption for a nitrogen generator plant capable of producing 5% of its production as liquid nitrogen is about 25% higher than that for a plant designed to produce only nitrogen gas, and such power loss is not recoverable after the storage tank is filled and liquid production is terminated.

U.S. Pat. No. 2,951,346 to Collins, et al. describes a stand-alone laboratory size liquid nitrogen generator, which produces relatively low purity liquid nitrogen from air.

U.S. Pat. No. 3,620,032 to Simonet describes a method for producing high purity oxygen from commercial grade oxygen. Oxygen from the sump is admitted to the distillation column at an intermediate point in the column.

U.S. Pat. No. 4,780,118 to Cheuno describes a process plant for ultrapurifying liquid oxygen.

U.S. Pat. No. 4,668,260; U.S. Pat. No. 4,671,813; and U.S. Pat. No. 4,698,079 to Yoshino describe plants for producing high purity nitrogen for use in electronics applications.

SUMMARY OF THE INVENTION

This invention provides an apparatus and process whereby merchant liquid nitrogen may be purified in a nitrogen generator to provide liquid nitrogen equivalent in quality to that produced by the generator, without loss of efficiency in nitrogen generation.

Further, this invention provides a means of reprocessing liquid nitrogen of standard commercial purity that is imported to a nitrogen generating site, to reduce its oxygen content to a level equivalent to that of liquid nitrogen produced by a nitrogen generating plant and store said nitrogen for "back-up" during periods of excess demand or plant outage or for export as premium grade liquid product. The foregoing objects are achieved by introducing into the distillation column of a nitrogen generator relatively low purity merchant liquid nitrogen at an intermediate point in the column wherein the column liquid stream composition is substantially equivalent to the merchant liquid nitrogen composition. A substantially equivalent amount of purified liquid nitrogen is withdrawn from the top of the column for storage and use during nitrogen generator plant outages or excess demand or for export.

DETAILED DESCRIPTION OF THE INVENTION

Figure 1:
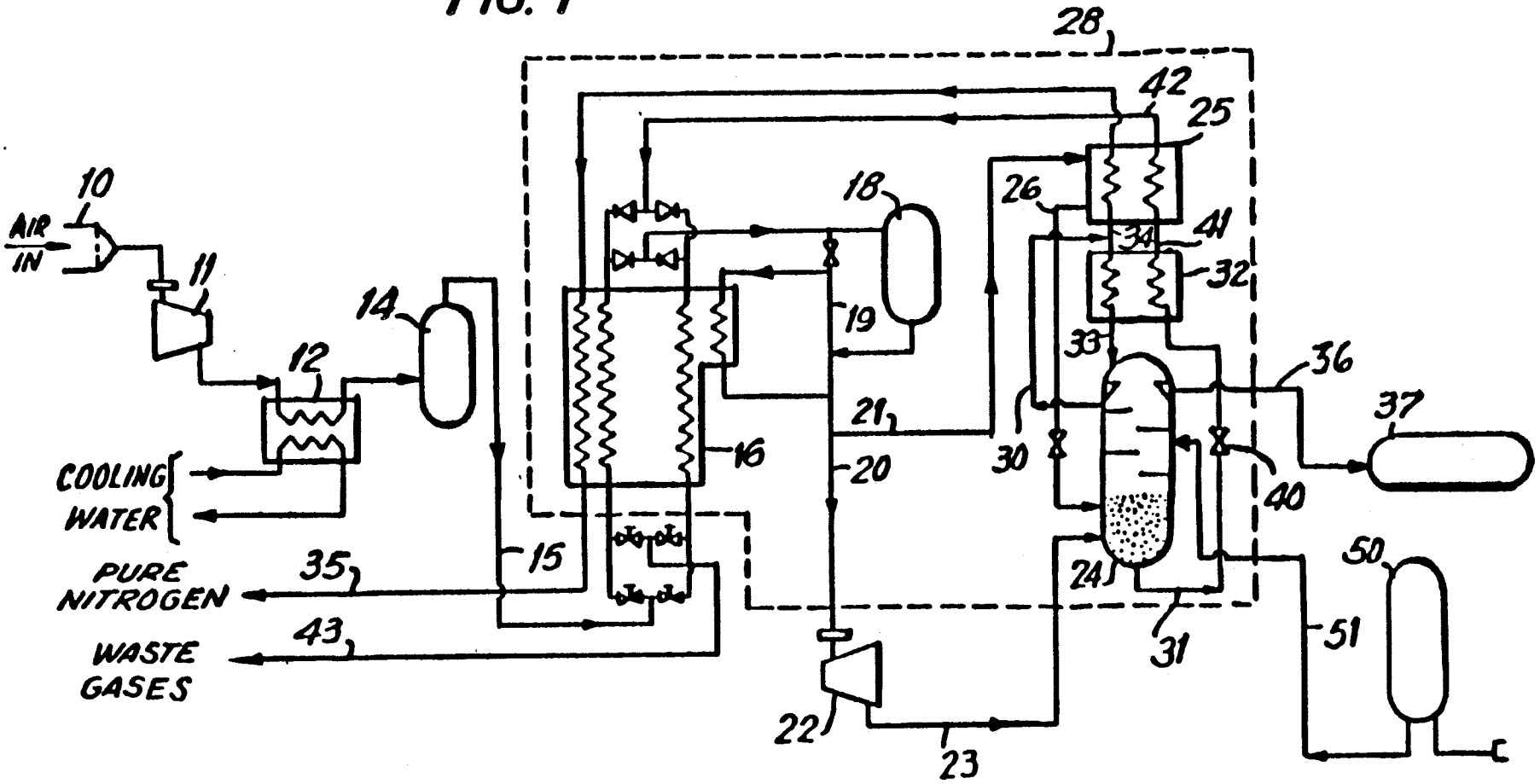
FIG. 1 is a simplified flow diagram of a typical nitrogen generator plant, including the process and apparatus of this invention.

The process and apparatus of this invention is preferably used in conjunction with a nitrogen generator plant which supplies nitrogen for inerting atmospheres for chemical processing, float glass manufacture, and silicon chip manufacture and, when mixed with hydrogen, for reducing atmospheres for metal heat treating. Such nitrogen generator plants may also be used for enhancing oil recovery by nitrogen injection into wells. The plants can be operated to produce ultrapure liquid nitrogen for electronics applications or operated to produce lower purity liquid nitrogen where that is adequate.

The invention herein is adapted for use in conjunction with such nitrogen generators in order to purify commercial or merchant grade liquid nitrogen for use during periods of nitrogen generator outage or excess demand for nitrogen or for export as a premium grade liquid product. It is possible to use the invention herein on nitrogen generators having single or multiple columns, e.g. double columns. The invention is dependent on the thermodynamic and equilibrium characteristics of high purity nitrogen distillation rather than on any particular process for generating nitrogen.

The invention is preferably used in conjunction with air expansion nitrogen generating plants and waste expansion nitrogen generating plants.

In general, air is a gaseous mixture containing oxygen, nitrogen, argon and certain rare gases in fixed quantities. These components are separated by such nitrogen generators through the use of low temperature distillation.

The air separation process used by the preferred nitrogen generators comprises:

1. Compressing air
2. Purifying and cooling to a liquid
3. Separating into component parts by low temperature distillation
4. Product recovery-rewarming of separated components.

COMPRESSING

Atmospheric air is filtered, compressed and cooled to ambient temperature in an aftercooler and delivered to a surge drum. The surge drum cushions the air compressor during exchanger reversals and separates condensed water vapor from the air stream.

COOLING

Compressed air enters the reversing exchangers, which have fixed passages for pure nitrogen product and reversing passages for the air and waste streams. Incoming air is cooled through heat exchange with nitrogen product and waste streams. As the temperature falls, water and carbon dioxide impurities are deposited on the exchanger surface. Periodically, the air and waste streams are reversed and these impurities are removed by the low pressure waste stream.

Reversals are controlled by a system of automatic reversing valves at the warm end, which operate at predetermined intervals. Check valves are used to control the flow at the cold end of the exchangers. Air from the reversing exchangers passes through a silica gel adsorber to remove traces of carbon dioxide and hydrocarbons. Part of the air is then partially rewarmed in a fixed pass of the reversing exchanger and then cooled and partially liquefied in the liquefier exchanger before entering the rectification column. The remainder of the air is expanded through an expansion turbine into the column. The expansion turbine provides the bulk of the refrigeration requirements of the system.

SEPARATING COMPONENTS

Air entering the high pressure rectification column is separated into a rising nitrogen-rich gas stream and a descending oxygen-rich liquid, which are in countercurrent contact with each other. The oxygen-rich liquid is drawn off at the bottom of the column and then expanded into the low pressure side of the reflux condenser where it vaporizes against condensing nitrogen reflux. The oxygen-rich vapor leaves the condenser as waste gas and is returned through the liquefier and reversing exchangers where it cools the incoming air stream.

The term "column" or "rectification column" as used herein means a distillation or fractionation column or zone, i.e., a contacting column or zone, wherein liquid and vapor phases are countercurrently contacted to effect separation of a fluid mixture, as for example, by contacting of the vapor and liquid phases on a series of vertically spaced trays or plates mounted within the column or alternatively, on packing elements with which the column is filled. The term, "double column" is used to mean a higher pressure column having its upper end in heat exchange relation with the lower end of a lower pressure column. The column of the nitrogen generator is provided with a means for introducing merchant liquid nitrogen into the distillation column at an intermediate distillation plate or position in the column, the plate having a column liquid stream substantially equivalent in composition to the entering merchant liquid nitrogen.

As used herein, the term tray or plate means a contacting stage, which is not necessarily an equilibrium stage, and may mean a contacting apparatus having packing capable of separation equivalent to one tray. The term "equilibrium stage" means a vapor-liquid contacting stage whereby the vapor and liquid leaving the stage are in mass transfer equilibrium, e.g. a tray having 100 percent efficiency or a packing element height equivalent to one theoretical plate.

PRODUCT RECOVERY

The nitrogen vapor from the top of the rectification column is returned through the liquefier and a fixed passage in the reversing exchangers to recover its refrigeration and cool the incoming gases.

Typically, when the invention herein is not used, the nitrogen generator is fitted with a liquid nitrogen control system which allows approximately 5% of the total nitrogen product to be withdrawn as liquid and stored for subsequent use. When utilizing the invention herein, however, purified liquid nitrogen is withdrawn from the top of the column in amounts substantially equivalent to the amount of merchant liquid nitrogen introduced to the column, while also producing nitrogen product gas. This purified liquid nitrogen is stored for use during excess demands for nitrogen or nitrogen generator plant outage or exported.

More specifically, referring to FIG. 1, depicting this invention used in a preferred nitrogen generator plant, air is drawn from the atmosphere through a dust filter 10 to the suction of multi-stage air compressor 11. The air is compressed in the compressor 11 and then cooled in an aftercooler 12 by cooling water. The air then passes through a surge drum 14. This drum 14 serves to reduce pressure fluctuations caused by changeovers of the reversing heat exchanger 16, and serves as a water separator.

Air enters the reversing heat exchanger 16, and is cooled to within a few degrees of its dewpoint. During passage through the exchanger 16, substantially all the remaining atmospheric water content and other impurities are deposited on the cold surfaces of the exchanger 16. If any trace impurities exist, they are separated from the air stream in a gas phase adsorber 18, which is packed with silica gel. Impurities which are deposited on the surface of the exchanger are periodically reabsorbed into the waste stream when changeover of the heat exchanger 16 occurs.

Part of the cold-purified air from the adsorber 18 is returned via conduit 19 through a pass of the reversing heat exchanger 16 to provide a means for balancing the temperature of the exchanger, and then rejoins the main air stream after the adsorber 18.

The air flow from the adsorber 18 is then divided into two streams 20, 21. The first stream 20 passes through an expansion turbine 22, and the expanded air stream 23 enters the base of the column 24 as a saturated gas just above its dewpoint. The second stream 21, passes through the liquefier exchanger 25, where the air is cooled and liquefied against other streams flowing countercurrently therethrough, and subsequently enters the separation column 24 via conduit 26.

In the preferred column 24, vapor passes upward through perforations of each sieve type distillation tray contacting the descending liquid. In accordance with known principles of distillation, air is separated into two main streams, (a) a nitrogen-rich product stream, which is withdrawn from the top of the column 24 as a gas stream 30, and (b) an oxygen-rich stream which collects in the sump of the column 24. A portion 33 of gaseous nitrogen stream 30 passes through condenser 32 where it is condensed and returned to column 24 to provide reflux. The remaining gaseous nitrogen 34 is warmed to ambient temperature by passing through liquefier 25 and through the reversing heat exchanger 16, leaving the cold box 28 via conduit 35, for immediate use. If adequate refrigeration is supplied by expansion turbine 22, more liquid reflux 33 may be produced than is required for distillation. The excess high purity liquid nitrogen product 36 is removed from the top of column 24 and sent to storage tank 37 where it can be utilized for plant back-up or exported for commercial sale.

The oxygen-rich stream 31 is expanded through a valve 40, and evaporated in the condenser 32. The gaseous oxygen-rich stream 41 is further warmed in liquefier 25 and then passed via conduit 42 through the section of the reversing heat exchanger 16 containing atmospheric impurities deposited from the previous cycle. These impurities are readsorbed due to the effect of both pressure and temperature differences between the air and waste streams. The waste gases 43 are then vented via a silencer (not shown) to the atmosphere.

Still referring to FIG. 1, in the improvement contemplated herein, merchant or commercial grade liquid nitrogen containing from 2 to 5 vppm oxygen is delivered to storage tank 50. Adequate pressure is maintained in storage tank 50 to transfer liquid nitrogen at a controlled rate through conduit 51 to an intermediate plate in distillation column 24. An approximately equivalent amount of purified (usually less than 0.5 vppm oxygen content) liquid nitrogen reflux returning from condenser 32 is withdrawn from the top of column 24 (above the top tray) and transferred either hydraulically or by pump through conduit 36 to storage tank 37.

Important characteristics of this invention are:

(a) purification of the merchant or commercial grade liquid nitrogen is accomplished at a column reflux liquid rate approximately equal to the reflux rate of a conventional nitrogen generator less the purified liquid nitrogen withdrawn. This results in a reduced liquid to vapor ratio in the section of the column above the merchant liquid nitrogen feed point;

(b) the merchant or commercial grade liquid nitrogen is introduced into the distillation column at a point where its composition matches that of the column liquid stream, typically several trays from the top; and (c) purified liquid nitrogen, e.g., having less than 0.5 vppm oxygen content, is withdrawn from the top of the column at substantially the same rate as the amount of merchant or commercial grade liquid nitrogen introduced to the column.

Figure 2:
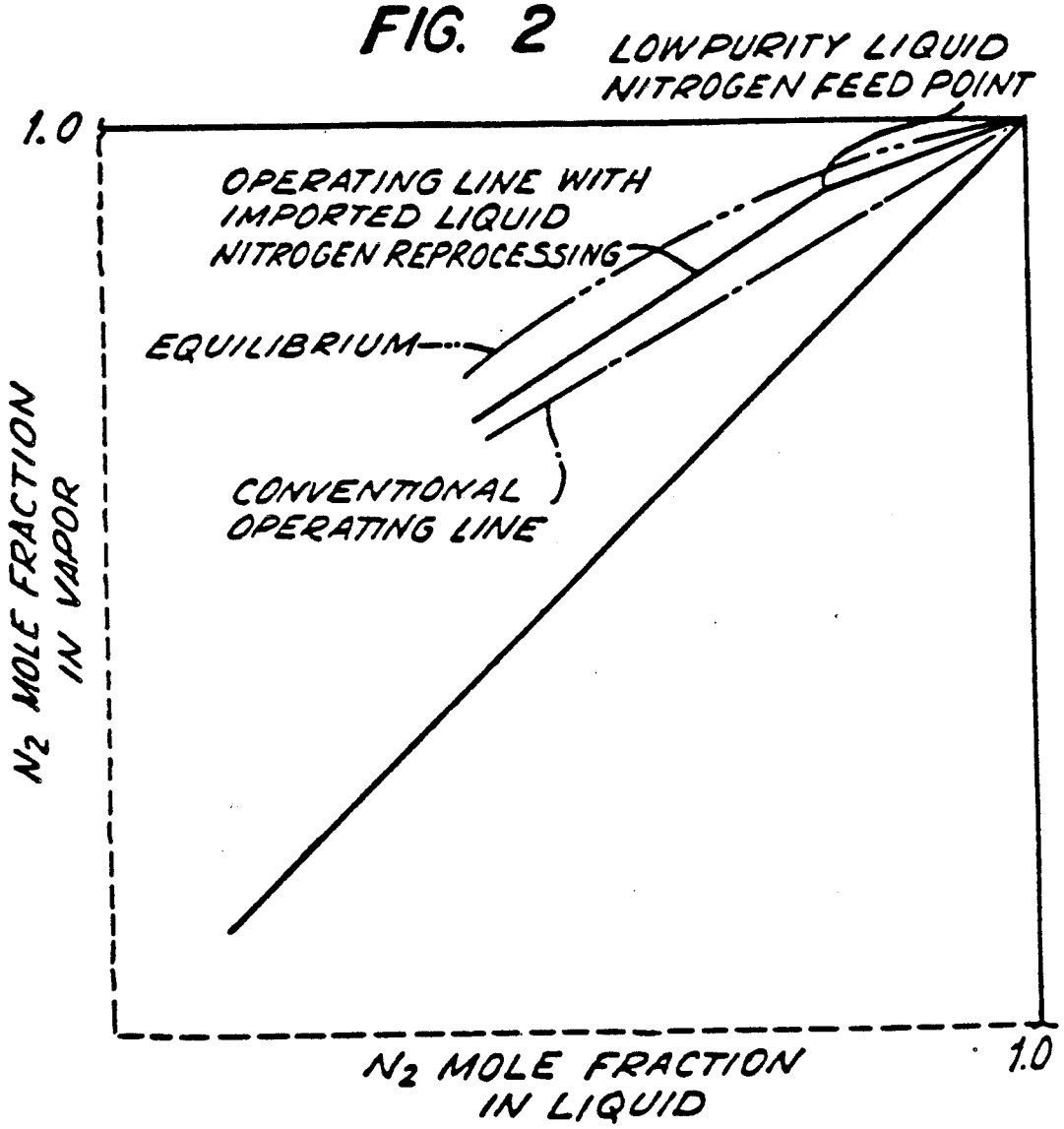
FIG. 2 is a schematic representation of the operating line of the distillation column using the process of this invention.

Referring to FIG. 2, the foregoing is possible because of the convex shape of the liquid-vapor equilibrium line for the oxygen-nitrogen system which permits a very high nitrogen purity to be achieved even at a reduced liquid to vapor ratio in the top section of the column. It can be seen that the slope of the operating line for the column above the feed point for the merchant liquid nitrogen is less than the operating line below the feed point. The slope of the equilibrium line in this region is also small, however, as long as the equilibrium, and operating lines do not intersect, the desired separation can be attained.

The maximum flow rate of merchant liquid nitrogen that can be processed is determined by the minimum reflux ratio for the trays above the merchant liquid feed point. It may be necessary to slightly reduce the gaseous nitrogen recovery to increase the liquid-vapor ratio (L/V) below the feed point so that product purity can be maintained.

Thus, with the use of this invention, the "on-site" nitrogen generator may be used to purify delivered commercial merchant grade liquid nitrogen to a product purity equivalent to that of the gaseous nitrogen produced by the nitrogen generator (less than 0.5 vppm) while simultaneously producing gaseous nitrogen for use.

Since the invention is based on the equilibrium properties of the oxygen-nitrogen system, it is applicable to all plant designs where separation of these components by distillation is employed. Although the quantity of merchant liquid nitrogen that can be purified is dependent on the particular nitrogen generator plant design, a processing rate of about 20% of total nitrogen production capacity can typically be achieved.

The application of this invention to a conventional waste expansion plant will reduce the filling time of a storage tank capable of supplying 30 days of "back-up" nitrogen from 25 days to 5 days. If this invention is used in conjunction with a nitrogen generating plant designed to produce only gaseous nitrogen, a similar storage tank can be filled in about 6.25 days at a 25% savings in power. Although a preferred embodiment of the invention has been described in detail, the invention is not to be limited to only such embodiment, but rather only by the appended claims.

What is claimed is:

1. An improved nitrogen generator having a distillation column operated at low tem for separating oxygen and nitrogen, the column having a top and a bottom, and a rising vapor stream and a descending liquid stream in countercurrent contact with each other, the improvement comprising:

means for introducing an amount of merchant liquid nitrogen into the column at an intermediate point in the column wherein the liquid stream composition at said point is substantially equivalent to the liquid nitrogen composition; and a means for withdrawing a substantially equivalent amount of purified liquid nitrogen from the top of the column.

2. The improved nitrogen generator of claim 1, further comprising:

a means for storing the merchant liquid nitrogen prior to introducing it into the column and a means for storing the purified liquid nitrogen after it is withdrawn from the column.

3. The improved nitrogen generator of claim 1, wherein the intermediate point is a distillation plate in the column wherein the liquid stream composition at said point is substantially equivalent to the liquid nitrogen composition.

4. The improved nitrogen generator of claim 1, wherein the oxygen concentration in the merchant liquid nitrogen is greater than the oxygen concentration in a gaseous nitrogen stream exiting the top of the column.

5. The improved nitrogen generator of claim 4, wherein the merchant liquid nitrogen contains about 0.5 to 5 vppm.

6. The improved nitrogen generator of claim 4, wherein the gaseous nitrogen stream contains less than about 0.5 vppm oxygen.

7. The improved nitrogen generator of claim 1 wherein the oxygen concentration in the purified liquid nitrogen is substantially the same as the oxygen concentration in a gaseous nitrogen stream exiting the top of the column.

8. The improved nitrogen generator of claim 7 wherein the purified liquid nitrogen contains less than about 0.5 vppm oxygen.

9. A nitrogen generator comprising:

means for compressing, cooling and filtering atmospheric air to a liquid;

a distillation column having a top and a bottom, for separating oxygen and nitrogen from the liquid air, and a rising vapor stream and a descending liquid stream, said streams in countercurrent contact with each other;

a means for removing a gaseous nitrogen-rich product stream from the top;

a means for storing merchant liquid nitrogen;

a means for introducing an amount of the merchant liquid nitrogen into the distillation column at an intermediate pointing the column, wherein the liquid stream composition at said point is substantially equivalent to the merchant liquid nitrogen composition;

a means for withdrawing a substantially equivalent amount of purified liquid nitrogen from the top of the column; and a means for storing the purified liquid nitrogen.

10. The nitrogen generator of claim 9, wherein the intermediate point is a distillation plate in the column.

11. The improved nitrogen generator of claim 9, wherein the oxygen concentration in the merchant liquid nitrogen is greater than the oxygen concentration in a gaseous nitrogen stream exiting the top of the column.

12. The improved nitrogen generator of claim 11, wherein the merchant liquid nitrogen contains about 0.5 to 5 vppm.

13. The improved nitrogen generator of claim 11, wherein the gaseous nitrogen stream contains less than about 0.5 vppm oxygen.

14. The improved nitrogen generator of claim 9 wherein the oxygen concentration in the purified liquid nitrogen is substantially the same as the oxygen concentration in a gaseous nitrogen stream exiting the top of the column.

15. The improved nitrogen generator of claim 14 wherein the purified liquid nitrogen contains less than about 0.5 vppm oxygen.

16. An improved nitrogen generating process including separating oxygen and nitrogen via a distillation column, operated at low temperature the column having a top and a bottom and a rising vapor stream and a descending liquid stream in countercurrent contact with each other, the improvement comprising:

introducing an amount of liquid nitrogen into the column at an intermediate point in the column wherein the liquid stream composition at said point is substantially equivalent to the liquid nitrogen composition; and withdrawing a substantially equivalent amount of purified liquid nitrogen from the top of the column.

17. The improved process of claim 16, further comprising: storing the liquid nitrogen prior to introducing it into the column and storing the purified liquid nitrogen after it is withdrawn from the column.

18. The improved process of claim 16, wherein the intermediate point is a distillation plate in the column wherein the liquid stream composition at said point is substantially equivalent to the liquid nitrogen composition.

19. The improved nitrogen generator of claim 16, wherein the oxygen concentration in the merchant liquid nitrogen is greater than the oxygen concentration in a gaseous nitrogen stream exiting the top of the column.

20. The improved nitrogen generator of claim 19, wherein the merchant liquid nitrogen contains about 0.5 to 5 vppm.

21. The improved nitrogen generator of claim 19, wherein the gaseous nitrogen stream contains less than about 0.5 vppm oxygen.

22. The improved nitrogen generator of claim 16 wherein the oxygen concentration in the purified liquid nitrogen is substantially the same as the oxygen concentration in a gaseous nitrogen stream exiting the top of the column.

23. The improved nitrogen generator of claim 22 wherein the purified liquid nitrogen contains less than about 0.5 vppm oxygen.

24. A nitrogen generating process comprising:

compressing, filtering, and cooling atmospheric air to a liquid;

separating oxygen and nitrogen from the liquid air via a distillation column having a top and a bottom, wherein the column has a rising vapor stream and a descending liquid stream, said streams in countercurrent contact with each other;

removing purified liquid nitrogen product from the top; storing merchant liquid nitrogen;

introducing an amount of the merchant liquid nitrogen into the distillation column at an intermediate point in the column wherein the merchant liquid nitrogen stream composition at said point is substantially equivalent to the liquid composition; withdrawing a substantially equivalent amount of purified liquid nitrogen from the top of the column; and storing the purified liquid nitrogen.

25. The nitrogen generating process of claim 24, wherein the stored purified liquid nitrogen is used during periods of demand for purified nitrogen which cannot be met by purified nitrogen product.

26. The nitrogen generating process of claim 24, wherein the stored purified liquid nitrogen is exported as a premium grade liquid product.

27. The process of claim 24, wherein the intermediate point is a distillation plate in the column.

28. The improved nitrogen generator of claim 24, wherein the oxygen concentration in the merchant liquid nitrogen is greater than the oxygen concentration in a gaseous nitrogen stream exiting the top of the column.

29. The improved nitrogen generator of claim 28, wherein the merchant liquid nitrogen contains about 0.5 to 5 vppm.

30. The improved nitrogen generator of claim 28, wherein the gaseous nitrogen stream contains less than 0.5 vppm oxygen.

31. The improved nitrogen generator of claim 24 wherein the oxygen concentration in the purified liquid nitrogen is substantially the same as the oxygen concentration in a gaseous nitrogen stream exiting the top of the column.

32. The improved nitrogen generator of claim 31 wherein the purified liquid nitrogen contains less than about 0.5 vppm oxygen.

* * * * *

UNITED STATES PATENT AND TRADEMARK OFFICE

CERTIFICATE OF CORRECTION

PATENT NO. : 5,058,387
DATED : October 22, 1991
INVENTOR(S) : David Kamrath

It is certified that error appears in the above-indentified patent and that said Letters Patent is hereby corrected as shown below:

Column 7, line 41, after "intermediate" the word -- Pointin -- should be "point in".

Signed and Sealed this

Twenty-eighth Day of September, 1993

Bruce Lehman

*Attest:*

BRUCE LEHMAN

*Attesting Officer*

*Commissioner of Patents and Trademarks*